United States Patent [19]

Swearingen

[11] Patent Number: 4,695,221

[45] Date of Patent: Sep. 22, 1987

[54] TURBINE SHUTDOWN CONTROL SYSTEM

[75] Inventor: Judson S. Swearingen, Malibu, Calif.

[73] Assignee: Rotoflow Corporation, Los Angeles, Calif.

[21] Appl. No.: 804,677

[22] Filed: Dec. 4, 1985

[51] Int. Cl.[4] ..... F01D 17/06

[52] U.S. Cl. ..... 415/36; 415/17; 415/30; 415/39; 290/40 R; 290/40 C

[58] Field of Search ..... 415/17, 29, 28, 30, 415/36, 38, 39; 290/40 C, 40 A, 40 B, 40 R

[56] References Cited

U.S. PATENT DOCUMENTS

| | | | |
|---|---|---|---|
| 3,055,181 | 9/1962 | Argersinger | 60/73 |
| 3,552,872 | 1/1971 | Giras et al. | 415/17 |
| 3,561,216 | 2/1971 | Moore | 415/17 |
| 3,601,617 | 8/1971 | DeMello | 290/40 C |
| 3,614,457 | 10/1971 | Eggenberger | 290/40 |
| 4,118,935 | 10/1978 | Anderson | 415/36 |
| 4,120,159 | 10/1978 | Matsumoto et al. | 60/667 |
| 4,187,685 | 2/1980 | Tsuji et al. | 60/660 |
| 4,309,873 | 1/1982 | Koran et al. | 60/646 |
| 4,398,393 | 8/1983 | Ipsen | 60/657 |
| 4,403,476 | 9/1983 | Johnson et al. | 60/652 |
| 4,426,845 | 1/1984 | Brooks et al. | 415/36 |
| 4,471,446 | 9/1984 | Podolsky et al. | 364/494 |
| 4,514,643 | 4/1985 | Condrac | 290/40 C |
| 4,625,123 | 11/1986 | Gillett et al. | 290/40 B |

*Primary Examiner*—Robert E. Garrett
*Assistant Examiner*—John Kwon
*Attorney, Agent, or Firm*—Lyon & Lyon

[57] ABSTRACT

A turbine shutdown control system for controlling a turbine powering two load groups. Upon loss of one load group, a first control valve will close to interrupt the fluid flow to the turbine. A second modulating valve in parallel with the first valve remains open to provide sufficient fluid flow to the turbine to power the second load group.

6 Claims, 1 Drawing Figure

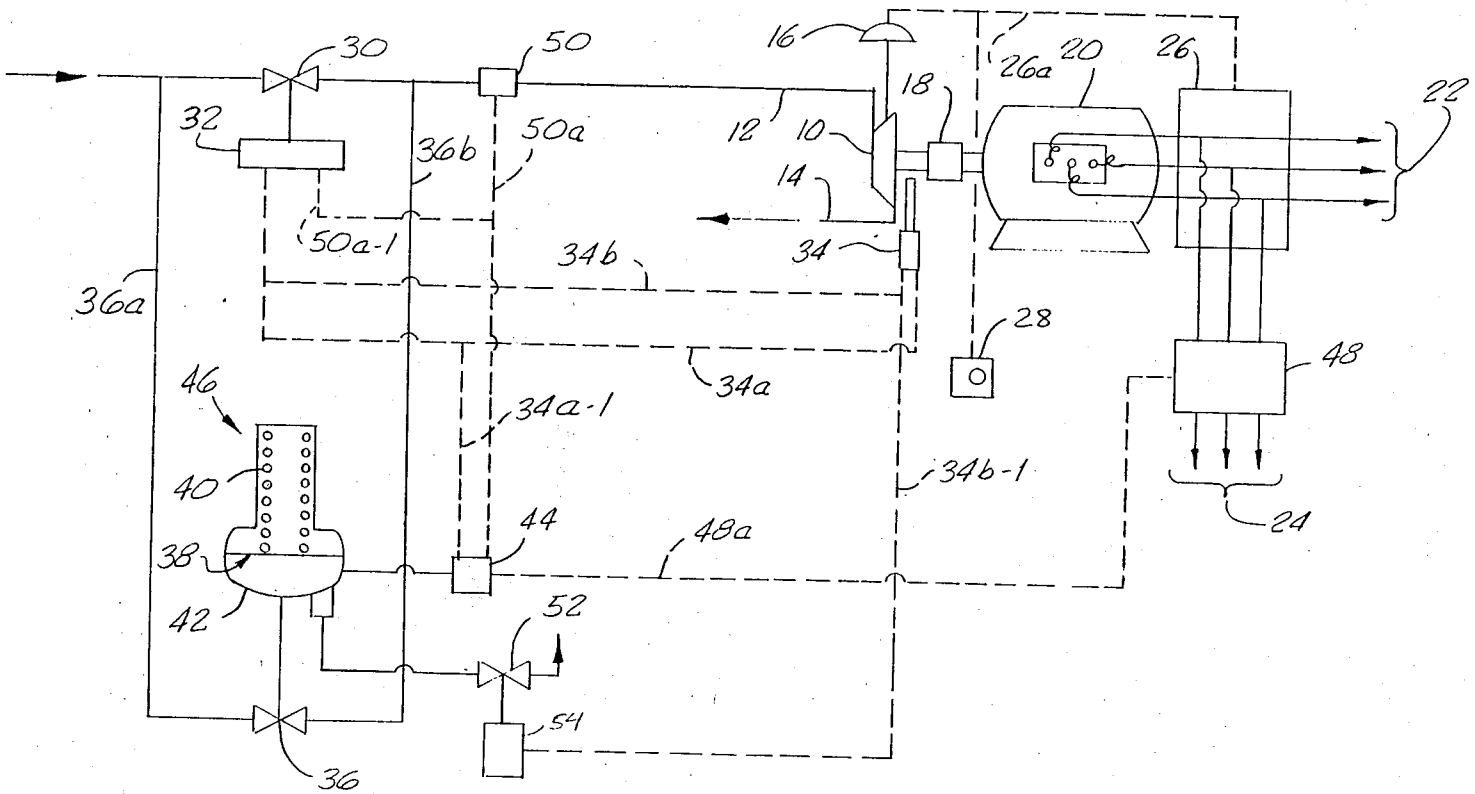
22
48
24
26
20
26a
28
34b-1
18
16
10
14
34
12
34a
48a
34b
34a-1
50
50a
44
52
54
36b
50a-1
30
36
32
46
40
38
42
36a

TURBINE SHUTDOWN CONTROL SYSTEM

BACKGROUND OF THE INVENTION

The field of the present invention is control systems for turbines, and more particularly, systems for preventing turbine overspeed upon loss of load.

In fluid driven turbines used for generating electrically or for performing other work, sudden load loss during normal operation is not uncommon. Should such load loss occur, the turbine, if unchecked, can quickly reach a destructive overspeed condition. To resolve this problem, it has been suggested to place an emergency control valve between the fluid source and the turbine inlet. The valve, in response to a turbine overspeed condition indicating loss of load, will immediately close to interrupt the flow of fluid to the turbine, thus resulting in complete turbine shutdown.

Although basically effective, such valves may not be satisfactory for all loading applications. For example, many turbines are utilized to drive primary and secondary load groups. Should the primary load group be lost, complete shutdown is undesirable. Rather, the turbine should continue to power the remaining secondary load group. Thus, a control system is needed for turbines driving multiple load groups that would prevent destructive turbine overspeed upon loss of one load group but which would allow the turbine to continue to drive the remaining load group(s).

SUMMARY OF THE INVENTION

The present invention is directed to a control system for a turbine driving main and auxiliary load groups wherein a main control valve between a fluid source and the turbine is closed upon loss of the main load and wherein a second control valve in parallel with the first control valve remains open to provide sufficient fluid to the turbine to drive the auxiliary load. The second control valve may then be gradually opened while turbine control nozzles are readjusting. When the second control valve reaches full open position, and the nozzles are properly adjusted, the main control valve can reopen and the turbine can resume normal operation. Should overspeed continue after the first control valve is tripped, the second control valve may also be closed to effect complete turbine shutdown.

Accordingly, it is an object of the present invention to provide a control system of the type described above wherein a turbine driving two loads is prevented from reaching a destructive overspeed condition upon loss of one load but is allowed to continue driving the second remaining load.

BRIEF DESCRIPTION OF THE DRAWINGS

A single FIGURE depicts a schematic representation of a turbine control system embodying the present invention.

DETAILED DESCRIPTION OF THE PREFERRED EMBODIMENTS

Referring to the FIGURE, a turbine 10 is disclosed having a fluid inlet 12, a discharge 14, a diaphragm actuated contoller 16 for its variable primary nozzle, and a transmission shaft system 18 for driving a generator 20. Power from the generator 20 is delivered to a main load grid through the lines 22 and to an isolated auxiliary load through the lines 24. Fluid flow, and hence generated power, is controlled by the variable nozzles operated by the controller 16. The controller 16 receives a modulating signal **26*a* delivered by an instrument 26 on the electric power output lines 22 and 24. The signal 26*a* to the controller 16 may be overridden by a manual control 28**.

The inlet 12 receives fluid from an external fluid source which is not shown. Disposed between the fluid source and the turbine inlet is an emergency trip valve 30. The valve 30 includes a valve controller 32 of any suitable type for rapidly closing and opening the valve in response to a signal. The controller 32 may be integrated with the valve 30 in a single unit or may be a separate component or group of components depending on design preference. The valve 30 normally remains open, but will rapidly close in response to a signal **34*a* delivered by a turbine shaft sensor 34. In the present embodiment, the sensor 34** includes a tachometer to monitor turbine shaft rotational velocity. It will be appreciated, however, that other indicia of load loss, shaft acceleration for example, could also be used to initiate the valve-crossing signal.

A bypass valve 36 is disposed between the fluid source and the turbine inlet in parallel with the valve 30 through fluid lines **36*a* and 36*b*. The valve 36 includes a valve controller or modulator of any suitable type for modulating the valve 36 in response to a signal. In the present embodiment, the controller comprises, collectively, a diaphragm 38, a spring 40, a chamber 42, and a control interface 44 for receiving a signal. Modulation of the valve 36 is achieved by controlling the forces acting on the diaphragm 38. The spring 40 positioned on one side of the diaphragm 38 exerts a valve closing force. Air pressure in the chamber 42 on the opposite side of the diaphragm 38 provides a valve opening force. The controller may of course either be integrated with the valve 36 in a single unit or constituted as a separate component or group of components. For example, in the present embodiment the diaphragm 38, the spring 40, and the chamber 42 are all disposed in a single housing 46. The control interface 44 is a separate component. Many other combinations would also be possible as a matter of design choice. Accordingly, the term "controller" as used in connection with the valves 30 and 36** is intended to include any component or group of components adapted to control a valve in response to a signal.

During normal operation, a load monitor 48 on the output lines 24 monitors variations in the auxiliary load. A corresponding signal 48a is generated by the monitor 48 and delivered to the control interface 44. The control interface 44, in turn, modulates the air pressure in the chamber 42, thereby maintaining the valve 36 at a setting which, with the turbine nozzles correspondingly adjusted, would just flow the amount of fluid necessary to drive the auxiliary load.

Thus, when the valve 30 trips shut, the valve 36, if the primary nozzles were not so wide open, would allow the turbine to immediately just carry the load required for driving the auxiliary load, while at the same time limiting acceleration due to loss of the primary load. Actually, however, with the nozzles opened out of proportion to fluid flow, efficiency will be low, and there will be a power deficiency. This, fortunately, permits the turbine to slow down, thereby offsetting the small overspeed occurring before the valve 30 closes. The control interface 44 that maintains the setting of the bypass valve 36 can be adjusted so that the valve setting will cause this aforementioned power deficiency to be equal to that needed to offset the aforementioned overspeed.

As indicated previously, when an over-speed condition is sensed, the turbine speed sensor 34 generates an overspeed signal 34*a* which is delivered to the valve 30, via the valve controller 32, to immediately close the valve. A simultaneous signal 34*a*-1 branches off from the signal 34*a* and is delivered to the control interface 44. The signal 34*a*-1 overrides the modulating signal 48*a* and signals the control interface 44 to begin pressuring the chamber 42, thereby causing the valve 36 to open. At the same time, the nozzle controller 16, responding to the signal 26*a*, causes the turbine inlet nozzles to begin closing to correct for loss of the main load. By adjustment of the control interface 44, the closure of the nozzles and the opening of the valve 36 are made to occur at approximately the same rate. Thus, the increase in fluid flow resulting from the opening of the valve 36 is counteracted by the closure of the primary nozzles so that turbine speed continues to match the demands of the auxiliary load.

As the primary nozzles close in response to loss of the main load in the manner described above, the fluid pressure in inlet 12 upstream of the nozzles begins to build. When the nozzles are correctly adjusted, and the bypass valve 36 is fully open, a pressure responsive switch 50 disposed between the turbine and the fluid source generates a signal 50*a*. Signal 50*a* is delivered to the control interface 44 and causes the control interface 44 to again modulate in response to the signal 48*a*. Signal 50*a*-1, branching off from signal 50*a*, is delivered to the valve 30 and causes the valve 30 to re-open. Normal operation will thence resume.

Should the turbine continue to accelerate despite generation of signal 34*a*, higher-speed valve closing signals 34*b* and 34*b*-1 will be generated by the turbine speed sensor 34. The signal 34*b* is delivered to the valve 30 via the valve controller 32. The signal 34*b*-1 is delivered to a solenoid valve 52 via a solenoid valve controller 54 causing the valve 52 to open rapidly. Opening the valve 52 vents the chamber 42 thereby permitting the spring 40 to rapidly close the valve 36. Thus, the valve 36 will act as a trip valve jointly with the valve 30 to effect complete turbine shutdown. The solenoid valve 52 and the solenoid valve controller 54 are part of the valve 36 "controller" previously discussed.

Thus, a turbine control shutdown system is disclosed for a turbine driving two load groups which, upon loss of one load group, will prevent destructive turbine overspeed while enabling the turbine to continue powering the remaining load group. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A turbine shutdown control system for a turbine powered by a fluid source and driving multiple load groups comprising a first valve disposed between the fluid source and the turbine;

a second valve disposed in parallel with said first control valve between the fluid source and the turbine;

means for sensing a turbine overspeed condition indicating loss of a selected load group and for closing said first control valve in response thereto;

means for monitoring a selected one of the remaining load groups and for controlling said second control valve to modulate fluid flow through said valve in an amount sufficient to drive said selected remaining load group, said monitoring and controlling means being continuously operable during both normal and overspeed running conditions of the turbine.

2. In a turbine powered by a fluid source and driving a load, a system to control turbine shutdown upon partial loss of load comprising a first valve disposed between the fluid source and the turbine;

a first valve controller for controlling said first valve in response to a turbine overspeed signal;

a second valve disposed between the fluid source and the turbine, in parallel with said first valve;

a second valve controller for controlling said second valve in response to a modulating signal;

a sensor responsive to changes in turbine shaft movement for generating a turbine overspeed signal upon loss of load, said overspeed signal being delivered to said first valve controller to close said first valve and interrupt fluid flow therethrough;

a load monitor responsive to changes in a selected portion of the load for generating a modulating signal, said modulating signal being delivered to said second valve controller to modulate fluid flow through said second valve in an amount sufficient to drive said selected portion of the load, said load monitor and said valve controllers being continuously operable during both normal and overspeed running conditions of the turbine.

3. The system set forth in claim 2 wherein the turbine includes adjustable control nozzles responsive to changes in applied turbine load and wherein said turbine overspeed signal generated by said sensor is also delivered to said second valve controller to override said modulating signal and open said second valve at a selected rate corresponding to the rate of nozzle adjustment.

4. The system set forth in claim 3 further including a pressure responsive switch disposed between the turbine and said valves, said switch delivering a valve opening signal to said first valve controller to open said first valve when a predetermined fluid pressure is reached in the turbine.

5. The system set forth in claim 2 wherein said sensor generates first and second turbine overspeed signals, said first signal being delivered to said first valve controller to close said first valve and said second signal being delivered to said first valve controller and to said second valve controller to close said first and second valves, respectively.

6. In a turbine driven by a fluid source through a fluid inlet line and powering two loads or groups of loads, a method of rapid power control to curtail turbine overspeed in response to loss of a first load or load group while maintaining power to the second load or load group comprising the steps of:

continuously monitoring to detect a turbine overspeed condition indicating a loss of a first load group;

rapidly closing a first control valve disposed in the fluid inlet line in response to a signal indicating loss of one load;

continuously monitoring the second load group and maintaining the opening of a second valve disposed in parallel with said first control valve prior to closure of said first control valve to provide sufficient fluid flow to the turbine to power the second load alone.

* * * * *